US011219986B1

(12) United States Patent
Davila

(10) Patent No.: US 11,219,986 B1
(45) Date of Patent: Jan. 11, 2022

(54) MODIFIED BASIN WRENCH

(71) Applicant: Horacio Davila, Camden, SC (US)

(72) Inventor: Horacio Davila, Camden, SC (US)

( * ) Notice: Subject to any disclaimer, the term of this patent is extended or adjusted under 35 U.S.C. 154(b) by 222 days.

(21) Appl. No.: 16/526,009

(22) Filed: Jul. 30, 2019

(51) Int. Cl.
*B25B 13/48* (2006.01)
*B25B 13/50* (2006.01)
*B25B 13/06* (2006.01)

(52) U.S. Cl.
CPC ..... *B25B 13/481* (2013.01); *B25B 13/06* (2013.01); *B25B 13/5091* (2013.01)

(58) Field of Classification Search
CPC ..... B25B 13/5091
See application file for complete search history.

(56) References Cited

U.S. PATENT DOCUMENTS 2,491,623 A * 12/1949 Sesak ..... B25B 13/48 81/99
4,485,702 A 12/1984 Swan
6,257,099 B1 7/2001 Rosenbaum
2004/0035260 A1* 2/2004 Adkison ..... B25B 13/48 81/124.2
2008/0066584 A1* 3/2008 Vines ..... B25B 13/48 81/124.2
2016/0325409 A1* 11/2016 Lanteigne ..... B25B 13/481
2017/0157749 A1* 6/2017 Levy ..... B25B 13/481
2021/0053195 A1* 2/2021 Tian ..... B25B 13/481

* cited by examiner

*Primary Examiner* — Hadi Shakeri
(74) *Attorney, Agent, or Firm* — Sanchelima & Associates, P.A.; Christian Sanchelima; Jesus Sanchelima

(57) ABSTRACT

A modified basin wrench including an elongated rod assembly, wrench head assembly, handle assembly, and a pivoting assembly is disclosed herein. The wrench head assembly is modified in a way to allow the user to fasten and/or loosen the water supply locknut and faucet shank nut simultaneously. The modified basin wrench further includes a handle assembly that is hingedly attached to the wrench head assembly by a pivot assembly in order to help the user grasp the faucet nut at a comfortable angle in hard to reach places. Furthermore, this can allow the user to fasten and loosen the water supply locknut and/or faucet shank nut without having to lie down. The modified basin wrench also includes a handle assembly that can be used to adjust the grip of the tool and allows the user to operate the wrench with one hand.

5 Claims, 4 Drawing Sheets

MODIFIED BASIN WRENCH

BACKGROUND OF THE INVENTION

1. Field of the Invention

The present invention relates to a modified basin wrench and, more particularly, to a modified basin wrench that ergonomically fastens and loosens a water supply locknut and faucet shank nut simultaneously in hard to reach areas.

2. Description of the Related Art

Several designs for a modified basin wrench have been designed in the past. None of them, however, include a modified basin wrench that is able to grip, fasten and loosen a water supply locknut and a faucet shank nut simultaneously in hard to reach areas.

Applicant believes that a related reference corresponds to U.S. patent No. 2016/0114468 for a basin wrench comprising an adjustable extension handle with a T-bar grip. However, it differs from the present invention because the reference fails to address the long-felt problem of having to fasten or loosen a water supply locknut and faucet shank nut in two or more steps. The present invention uses a modified wrench head with slits and a through hole that cooperates with the shape of the nut to fasten and loosen them both simultaneously.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to teach of a modified basin wrench that permits users to fasten and/or loosen a locknut on a water supply connector using slits on the wrench head and a nut on the faucet shank using grooves within the wrench head, simultaneously, thus reducing the labor time involved with this operation.

It is another object of this invention to provide a modified basin wrench that can reach hard to access areas under a sink by using an elongated rod assembly.

It is still another object of the present invention to teach of a modified basin wrench that includes an articulating wrench head assembly using a pivoting assembly to easily maneuver around a sink cabinet.

It is still another object of the present invention to provide the user a greater dexterity when using the modified basin wrench.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
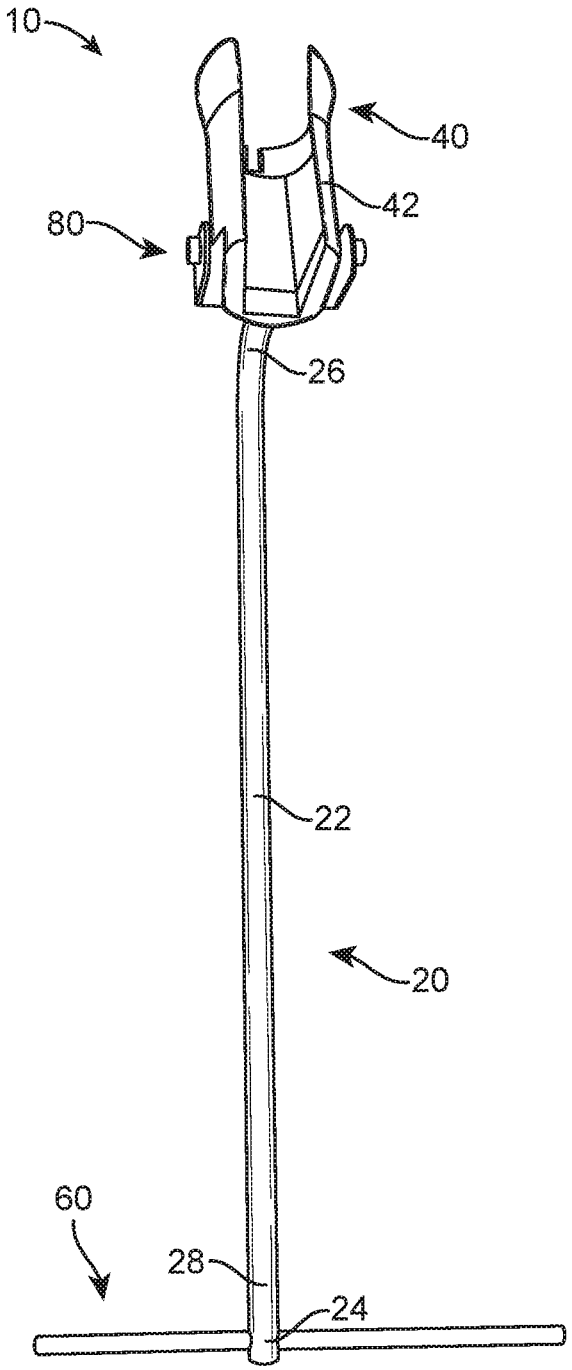
FIG. 1 represents an isometric view of the present invention showing elongated rod assembly 20, wrench head assembly 40, handle assembly 60, and pivot assembly 80. Elongated rod member 22 can be seen mounted to handle 62 using opening 24.
Figure 2:
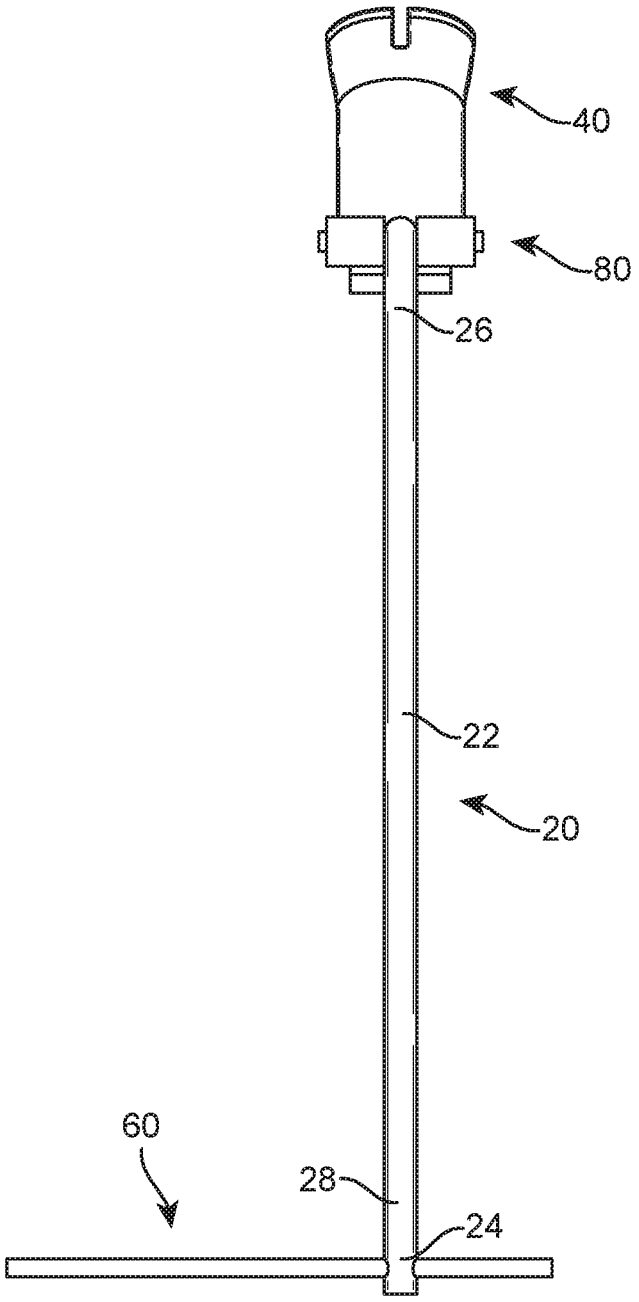
FIG. 2 illustrates a back view of the modified basin wrench 10 wherein elongated rod assembly 20, wrench head assembly 40, handle assembly 60, and pivot assembly 80 may be observed in accordance to one embodiment of the present invention.
Figure 3:
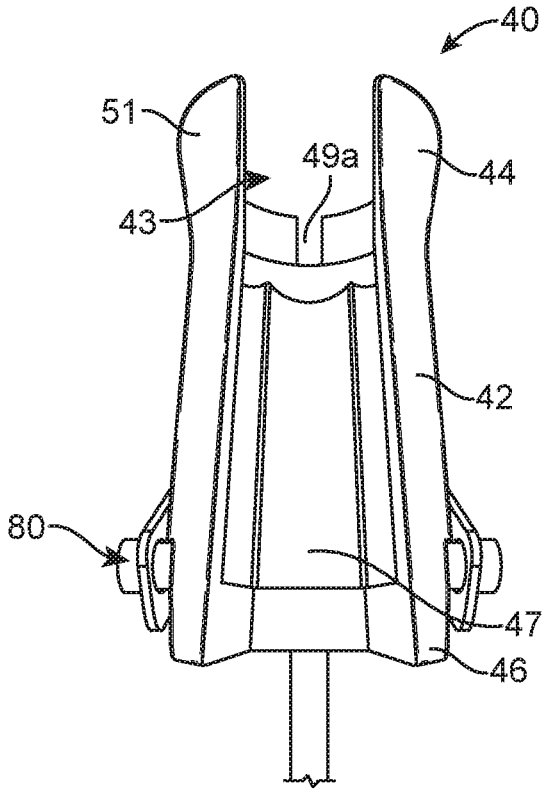
FIG. 3 shows an enlarged view of wrench head assembly 40 showing wrench head member 42, open side face 43, top wrench head end 44 tapering outwardly, bottom wrench head end 46.
Figure 4:
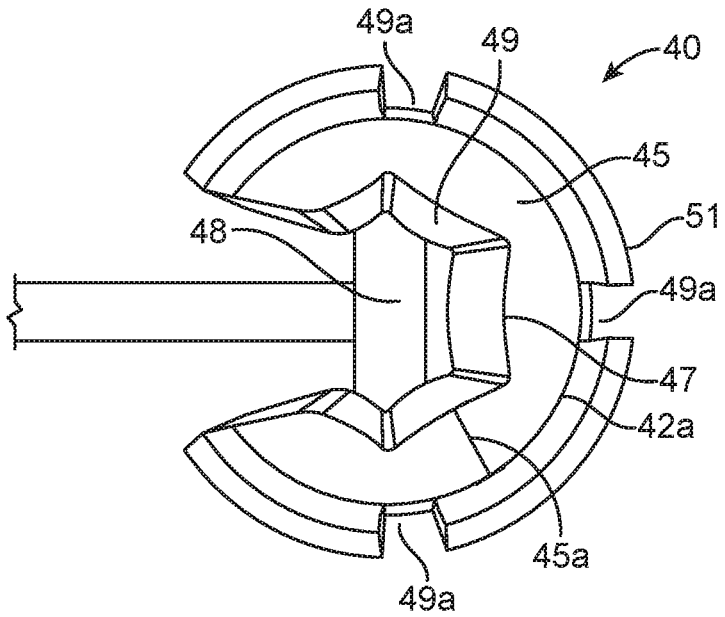
FIG. 4 illustrates a top view of wrench head assembly 40 showing interior mold 45 having thickness 45*a* that extends from inner wrench head side walls 42*a* to throughhole 47 that has a substantially hexagonal shape, and grooves 49 defining the hexagonal shape. Interior mold 45 can also be seen having interior mold top side 45*a*. Slits 49*a* can be seen extending from interior mold top side 45*a* to top distalmost end 51.
Figure 5:
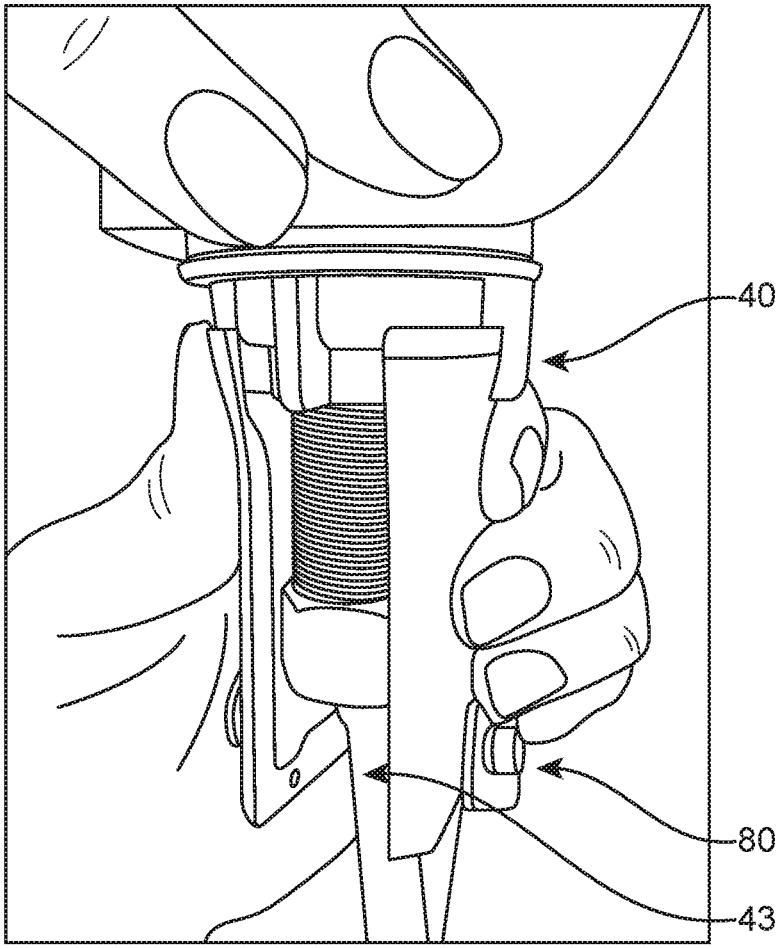
FIG. 5 is a representation of the present invention 10 in its operating environment.

Referring now to the drawings, where the present invention being a modified basin wrench is generally referred to with numeral 10, includes elongated rod assembly 20, wrench head assembly 40, handle assembly 60, and a pivoting assembly 80.

Elongated rod assembly 20 includes elongated member 22 that extends out of the bottom wrench head assembly 40. Elongated member 22 has a length that cooperates with helping a user reach hard to access water supply locknuts and faucet shank nuts in sinks. In one embodiment this length is greater than the depth of most, if not all, sink cabinets. Elongated member 22 has a diameter that cooperates with giving the present invention 10 a small profile so that it overcomes obstacles in its path such as plumbing fixtures, pipes, and the like. In one embodiment this diameter is less than the diameter of wrench head assembly 40. Opposite of wrench head assembly 40, elongated member 22 is mounted to handle assembly 60. In one embodiment, elongated member 22 is perpendicularly mounted to handle assembly 60. Elongated rod assembly 20 also includes a handle insertion opening 24 that receives handle assembly 60 therethrough. Elongated rod member 22 has top distal end 26 and a bottom distal end 28. Handle insertion opening 24 is located at bottom distal end 28, in one embodiment. Handle assemble 60 can slide back and forth through insertion opening 24 thereby allowing the user to adjust the grip of handle assembly 60. As a result, a user may be able to operate the present invention 10 with at least one hand.

Wrench head assembly 40 includes wrench head member 42 that can be hingedly mounted using pivoting assembly 80 to elongated rod assembly 20 adjacent to or at top distal end 26. Wherein said pivoting assembly 80 is attached to a bottom wrench head 46 through fastening members. Pivoting assembly 80 may be rectangular in shape comprising of an open side on one of the longer sides. The open side of said rectangle will be the width necessary to fit unto bottom wrench head 46. Wrench head member 42 in one embodiment has a cylindrical configuration with a side open face 43 extending entirely from a top wrench head end 44 to bottom wrench head end 46. Top wrench head end 44 can taper outwardly with respect to the rest of wrench head member 42. Wrench head member 42 includes a top open face 48 that receives a water supply locknut and a faucet shank nut simultaneously. Wrench head member 42 houses an interior mold 45 that has a thickness and an interior mold top side 45*a*. Interior mold 45 has a thickness that extends from interior wrench head walls 42*a* inwardly to a throughhole 47. Throughhole 47 extends through interior mold 45 and has a shape that cooperates with the shape of a faucet nut shank to receive therein.

In one embodiment, throughhole 47 is of a shape that substantially resembles a hexagon. However, there is no base to this hexagon-like opening because what would be the base blends into side open face 43. This is so a user can insert a water supply locknut and a faucet shank nut into throughhole 47. Throughhole 47 has a shape defined by grooves 49 whose shape is determined based on the type of nut a user seeks to fasten or unfasten. In a conventional environment, a faucet includes a screw like member extending from its base into the sink cabinet. A faucet nut and a water supply connector are both mounted to this screw like member. Currently users and/or plumbers need two tools and/or two hands to unfasten these components. The present invention uses through holes 47 to grasp and tighten or release the faucet nut and includes vertical slits 49*a* to engage and tighten and/or release the water supply locknut. In one embodiment, there is a distance between a top distal most end 51 of the wrench head member 42 and interior mold top side 45*a*. Slits 49*a* can extend from top distal most end 51 to interior mold top side 45*a*. Slits 49*a* cooperate with the flanges that surround the circumference of the water supply locknut. Wrench head member 42 has a height large enough to grasp the faucet shank nut also known as the water supply connector in this application and the water supply locknut (or coupling nut) at the same time.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A modified basin wrench, comprising:

a. a wrench head assembly having a wrench head member having a cylindrical shape and a circumference, the wrench head member including longitudinal opening that extends entirely from a top wrench head end to a bottom wrench head end, the top wrench head end is located at the top distalmost end of said wrench head member, said wrench head member includes inner walls, said wrench head assembly includes an interior space having an interior mold therein, said interior mold having a thickness that extends from said inner walls inwardly towards a throughhole that is in a shape that cooperates with receiving and rotating a nut sought to be loosened or fastened, said top wrench head end includes a plurality of vertical slits that extend from said interior mold to said top distalmost end, said throughhole extends along the length of said wrench head member a sufficient distance so that each of said vertical slits can receive and secure a respective locknut flange while a nut can be rotated by the shape of said throughhole at the same time, said vertical slits have a height that is greater than said interior mold thickness;

b. an elongated rod assembly having an elongated rod member that has an elongated rod member length, said elongated rod member also has a diameter that is less than said wrench head assembly, the elongated rod including a top distal end and a bottom distal end, the top distal end including a curvature;

c. a handle assembly including a handle member that is perpendicularly mounted to said elongated rod member, said handle member having a length that is less than said elongated rod member length, wherein the handle member is a cylindrical member that traverses the elongated rod member entirely, the handle member being entirely above said bottom distal end of the elongated rod; and d. a pivot assembly that includes a C-shaped bracket that wraps partially around said bottom wrench head end on both sides of said opening and is hingedly mounted to said wrench head member using screws, the pivot assembly including a rear face that is mounted to the top distal end of the elongated rod.

2. The modified basin wrench of claim 1 wherein said shape is hexagonal.

3. The modified basin wrench of claim 1 wherein said elongated rod member includes an opening at said bottom distal end and is mounted to said wrench head at said top distal end.

4. The modified basin wrench of claim 3 wherein said elongated rod member is mounted to a handle assembly using said opening.

5. A modified basin wrench, consisting of:

a. a wrench head assembly having a wrench head member having a cylindrical shape and a circumference, the wrench head member including a longitudinal opening that extends entirely from a top wrench head end to a bottom wrench head end, the top wrench head end is located at the top distalmost end of said wrench head member, said wrench head member includes inner walls, said wrench head assembly includes an interior space having an interior mold therein, said interior mold having a thickness that extends from said inner walls inwardly towards a throughhole that is in a shape that cooperates with receiving and rotating a nut sought to be loosened or fastened, said top wrench head end includes a plurality of vertical slits that extend from said interior mold to said top distalmost end, said throughhole extends along the length of said wrench head member a sufficient distance so that each of said vertical slits can receive and secure a respective locknut flange while a nut can be rotated by the shape of said throughhole at the same time, said vertical slits have a height that is greater than said interior mold thickness, wherein said top wrench head end tapers outwardly with respect to the rest of said wrench head member;

b. an elongated rod assembly having an elongated rod member that has an elongated rod member length, said elongated rod member also has a diameter that is less than said wrench head assembly, the elongated rod including a curvature at a top distal end;

c. a handle assembly including a handle member that is perpendicularly mounted to said elongated rod member, said handle member having a length that is less than said elongated rod member length, wherein the handle member is a cylindrical member that traverses the elongated rod member entirely, the handle member being entirely above said bottom distal end of the elongated rod; and d. a pivot assembly that includes a C-shaped bracket that wraps partially around said bottom wrench head end on both sides of said opening and is hingedly mounted to said wrench head member using screws, the pivot assembly including a rear face that is mounted to the top distal end of the elongated rod.

* * * * *